US005897027A

United States Patent [19]

Steiner et al.

[11] Patent Number: 5,897,027

[45] Date of Patent: Apr. 27, 1999

[54] NOVELTY MOUNTABLE HEAD

[75] Inventors: Gregory A. Steiner, Lombard; Terry Arnieri, Addison, both of Ill.

[73] Assignee: Innovative Design Enterprises, Inc., Addison, Ill.

[21] Appl. No.: 09/028,021

[22] Filed: Feb. 23, 1998

[51] Int. Cl.[6] ..... B67D 5/00

[52] U.S. Cl. ..... 222/78; 222/383.1

[58] Field of Search ..... 222/78, 383.1; 446/75; 239/211

[56] References Cited

U.S. PATENT DOCUMENTS 5,385,276 1/1995 Yen-tang ..... 222/78

5,482,187 1/1996 Poulsen et al. ..... 222/383.1

*Primary Examiner*—Philippe Derakshani

*Attorney, Agent, or Firm*—Basil E. Demeur; Alan B. Samlan; Robert L. Knechtel

[57] ABSTRACT

There is disclosed a novelty head formed of a moldable material suitable for mounting and seatment upon a squirt trigger type bottle of the type including a bottle having a neck and a cap fitted onto the neck, and a squirt trigger assembly mounted onto the cap which includes a reciprocating trigger and a squirt nozzle positioned above the reciprocating trigger. The novelty head is three-dimensional and is formed of a substantially moldable material, the head defining a hollow chamber for accommodating the squirt trigger assembly therein. The lower portion of the head includes a first opening which is substantially key-hole shaped, consisting of a circular opening portion and having a substantially rectangular opening extending laterally from said circular opening, and a second opening spaced upwardly from the first opening. The head is mounted to the bottle by inserting the top portion of the cap of the bottle into the circular opening, with the reciprocating trigger extending through the rectangular portion of the opening, and the second opening accommodates the insertion of the squirt nozzle therethrough. The novelty head may further include a moveable jaw portion including an attachment tab mountable to the trigger to permit movement of the jaw in response to the reciprocating movement of the trigger.

11 Claims, 6 Drawing Sheets

FIG. 3
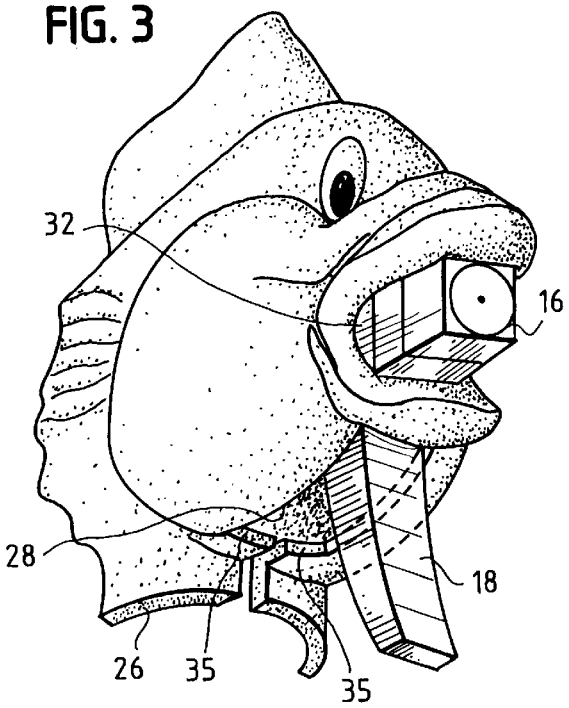
FIG. 5
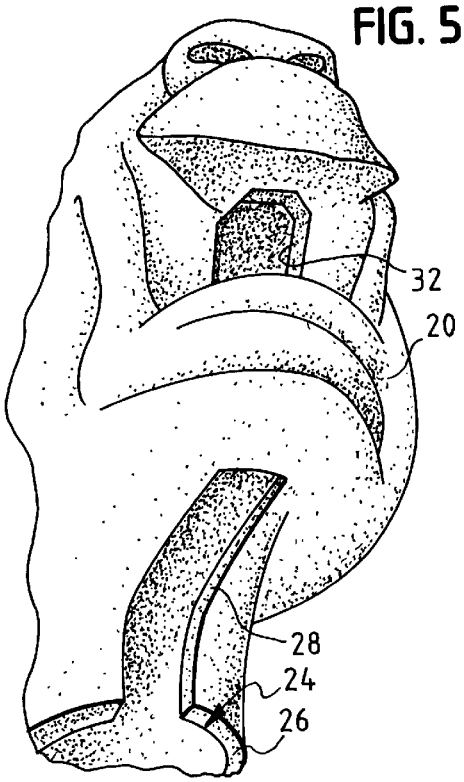
FIG. 4
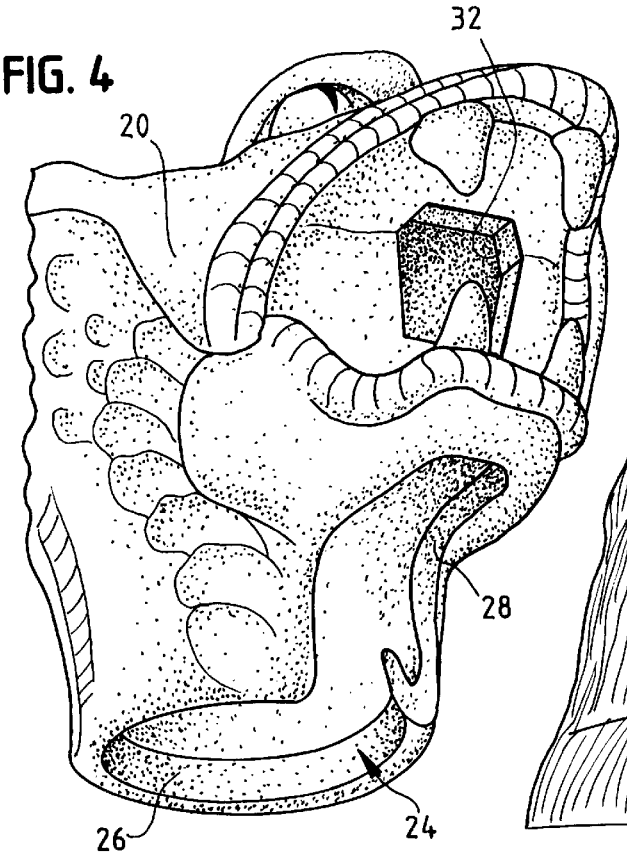
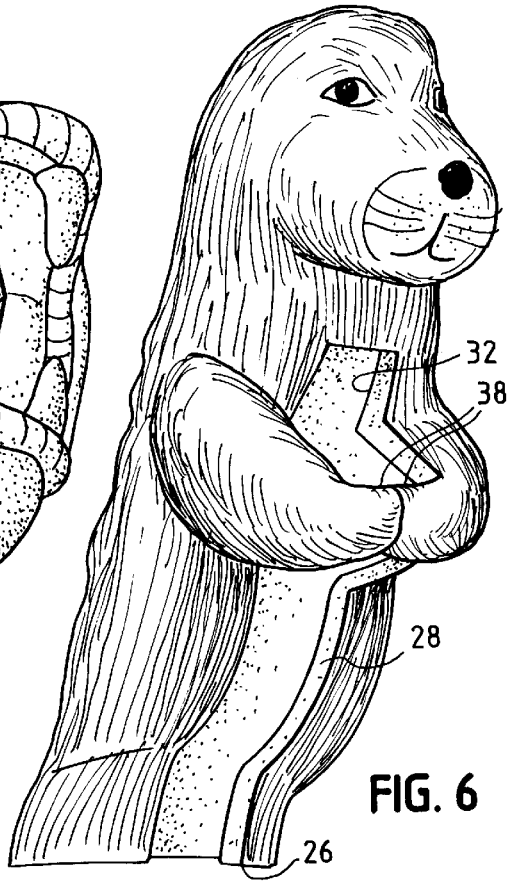
FIG. 6

FIG. 7
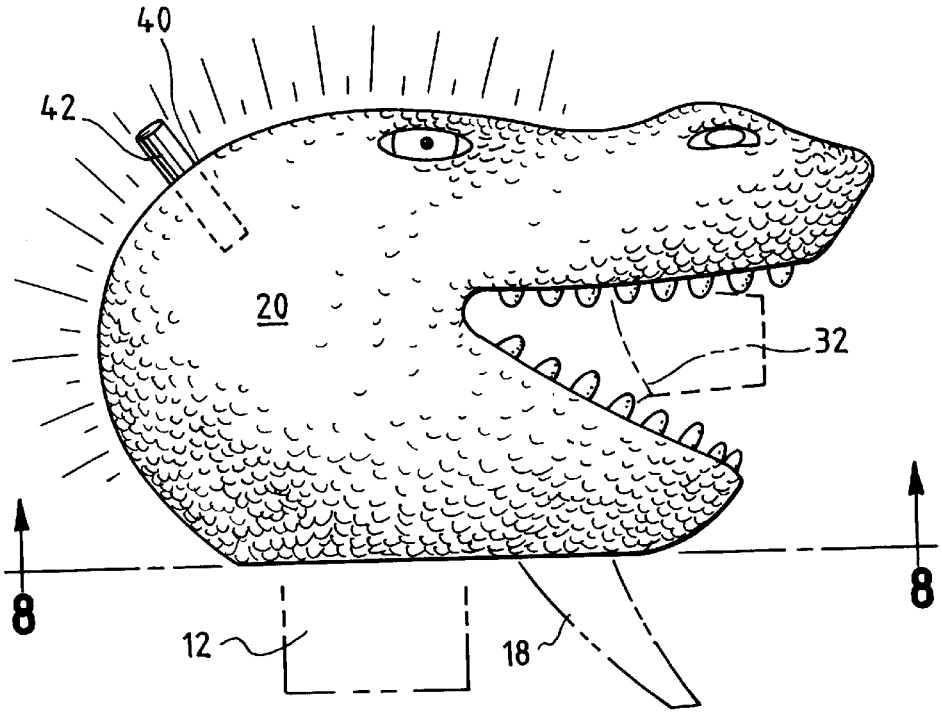
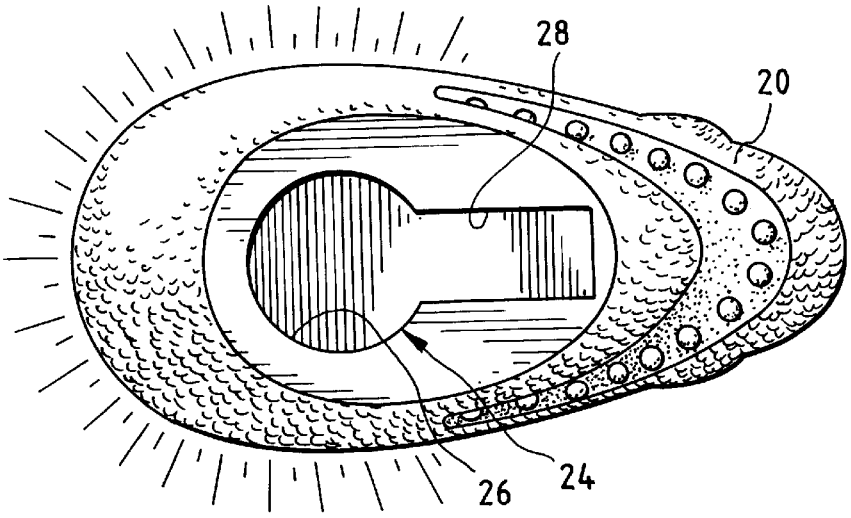
FIG. 8

NOVELTY MOUNTABLE HEAD

BACKGROUND OF THE INVENTION

The present invention relates to a novelty device particularly suited and useful by children. The present invention relates to a formed head suitable for mounting on a squirt trigger bottle of the type commonly employed with household cleaners and containing fluids intended to be ejected from the bottle by reciprocating a squirt trigger in order to eject the fluid from the squirt nozzle.

Various types of containers such as bottles and the like having caps have heretofore been formed of various types of novelty head formed on the cap, especially in connection with containers which contain a product particularly designed to be marketed for or to children. Examples of such devices would consist of bottles containing multiple vitamins for children, and in order to make the packaging attractive to children, will employ some type of head formed on the cap of the bottle in the nature of a clown or a similar type novelty head for attractive purposes. Various patents in the patented art show different types of figures intended for the tops of bottles and the like. For example, Pat. No. 3,420,412 shows an entire enclosure for a spraying device, such as a spray can, wherein the enclosure assumes the figure of an animal of some type, and has an opening at the mouth portion of the enclosure from which the fluid from the spray can emanates.

Another form of a enclosure for a squirt container is shown in Pat. No. 4,193,517. This enclosure is formed of a flexible material, and is slidably secured to the top of the container. As shown in FIG. 1 of the drawings, the head enclosure would incorporate two openings, one to be secured around the neck of the container, and a second opening for the ejection of the fluid through the mouth portion of the formed head. The aforementioned two patents, however, would not accommodate a squirt trigger bottle since there is no manner provided in which they could accommodate the trigger to extend through an opening, and even more importantly, to accommodate the reciprocating motion of the trigger incident to the pumping and squirting operation.

The same is true of Pat. No. 2,543,850, which again shows a animal type figure forming a head for a pump bottle to eject fluid through the mouth of the head enclosure.

Other patents include Pat. No. 5,125,577 which shows a formed head intending to be inserted over a water ejecting fixture such as a bath tub nozzle, but again, only includes a large circular opening to encircle the base of the water ejection fixture, and a second opening which is usually the mouth of the formed head in order to accommodate the ejection of the fluid therefrom. Such types of enclosures could not accommodate a squirt trigger bottle.

The present invention is intended as an improvement in the art relating to flexibly formed and/or molded enclosures for a squirt trigger bottle which enables the head to be inserted over the common squirt trigger bottle of the type presently available, and operates to permit the squirt trigger to be reciprocated incident to the pumping and ejection motion necessary to eject a fluid.

The present invention has as its goal to provide a novelty head generally formed in the nature of an animal or other figure of some type, and is designed to be positioned onto the top of a squirt trigger bottle. The squirt trigger bottle intended is the type generally having a bottle having a threaded neck, and a cap threaded to the neck of the bottle. The cap includes a squirt trigger assembly consisting of a squirt trigger carried below a squirt nozzle, the entire assembly basically consisting of a pump assembly such that the operator, by reciprocating the trigger, brings a fluid up and ejects the same through the squirt nozzle of the device.

Such types of squirt trigger bottles are commonly known in the art, and are generally useful for the vending of products such as glass cleaners, household cleaners and the like.

The present invention, and the novelty associated therewith, resides in the particular construction of the head which makes the formed head suitable for seatment onto the top of such standard squirt trigger assembly type bottle and thereby provides a standard squirt trigger assembly type bottle to be converted into a novelty item for a child.

SUMMARY OF THE INVENTION

In summary, the present invention relates to the provision of a formed novelty head adapted for seatment upon a squirt trigger bottle of the type which includes a bottle having a neck, and a cap fitted onto the neck. A squirt trigger assembly is mounted onto the cap, which includes a reciprocating trigger, and a squirt nozzle positioned above the reciprocating trigger and adapted to eject the fluid through the squirt nozzle when the trigger is reciprocated.

The formed head of the present invention is three-dimensional in configuration, and is formed of a moldable material, such as rubber, plastic or the like. The head defines a hollow chamber which accommodates the squirt trigger assembly therein, and has a lower portion. The lower portion includes a first opening which is a substantially keyhole-shaped opening consisting of a substantially circular opening, and a substantially rectangular opening extending laterally from the circular opening. A second opening is provided spaced upwardly from the first opening. The first opening is adapted to seat the head onto the cap of the bottle by inserting the cap of the bottle into the substantially circular opening, with the reciprocating trigger extending through the substantially rectangular opening which extends laterally outwardly from the circular opening. The substantially rectangular shape of that portion of the opening is intended to accommodate the reciprocation of the trigger as the device is used by the user.

The second opening accommodates the insertion of the squirt nozzle therethrough, such that when the entire head is mounted onto the cap of the bottle, the squirt nozzle will extend through the second opening in order to freely eject fluid once the head is mounted, while the circular opening securely and snugly mounts the head to the cap of the bottle, and the rectangular opening accommodates the reciprocating trigger therethrough, and also accommodates the reciprocating motion of the trigger when the device is used by the user.

A further embodiment of the invention would further include a novelty head of the type described which further includes a lower jaw portion which is moveable in response to the reciprocating movement of the squirt trigger. The lower jaw is therefore formed of a separate element which connects to the head portion by means of a pair of tabs, and accommodates a connection tab which mounts to the squirt trigger such that when the trigger is pulled inwardly toward the bottom, the jaw is moved downwardly thereby to expose the squirt nozzle, and permit the ejection of fluid therefrom. Another feature of the invention permits the insertion of a glow bar which may be inserted through an appropriate aperture in the novelty head and when activated, emits light and thereby causes the head to glow from light emitted from the inside of the hollow chamber of the novelty head.

The invention is best described and understood by reference to the following drawings and specification which are further described as set forth hereinbelow.

BRIEF DESCRIPTION OF DRAWINGS

FIG. 3 is a front plan view illustrating still another format for a novelty head having a different shape, but embodying the invention of the present invention in order to mount the same to a squirt trigger bottle;

FIG. 4 is a front elevational view showing an alternate format for a novelty head in accordance with the present invention wherein the opening in the lower portion of the head includes an elevated rectangular shaped opening in order to accommodate the shape of the head;

FIG. 5 illustrates still another alternate embodiment of a novelty head formed in accordance with the present invention, again showing an alternate configuration for the rectangular shaped opening extending laterally outwardly from the circular opening in the lower portion of the head.

FIG. 6 illustrates still another alternative novelty head in accordance with the present invention illustrating still a further configuration for having a keyhole-shaped opening with the rectangular portion of the opening extending in an arcuate path upwardly from the circular opening;

FIG. 7 is a side elevational view illustrating still another format for a novelty head in accordance with the present invention wherein the lower portion of the head incorporating the circular opening and rectangular opening illustrates those openings being in planar orientation relative to each other and further showing a glow bar mounted in the head portion;

FIG. 8 is a bottom view, in cross-section, taken along the line 8—8 if FIG. 7 illustrating the planar orientation of the circular opening and rectangular opening relative to the head illustrated in FIG. 7.

DETAILED DESCRIPTION OF DRAWINGS

Figure 1:
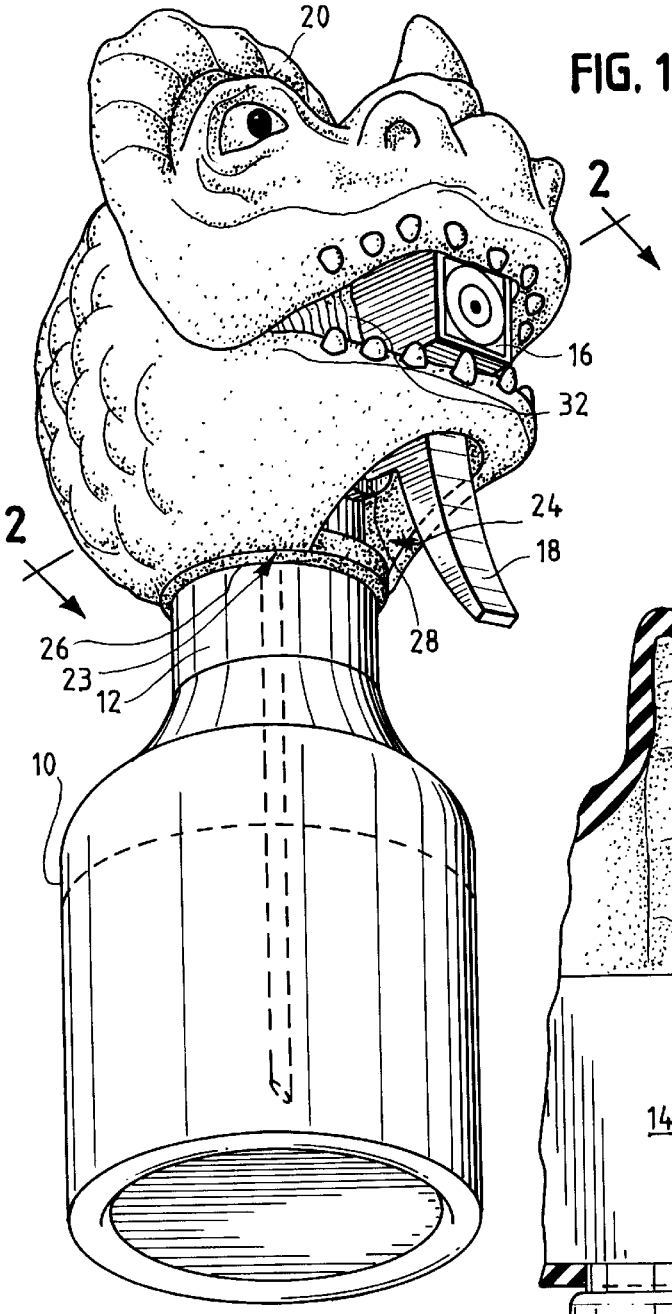
FIG. 1 is an elevational plan view of a typical squirt trigger bottle having a novelty head of the present invention mounted thereon.

As indicated, the present invention has as its purpose, the provision of a novelty head suited and adapted for seatment onto the top of a typical squirt trigger bottle assembly. As shown in FIG. 1, a typical squirt bottle assembly is illustrated, and is shown to generally consist of a bottle 10, which in the typical commercially available embodiment generally has a threaded neck portion (not shown). A cap 12 is shown to be mounted on the neck portion of the bottle, and is customarily known, generally is a threaded cap which screw threads onto the threads of the neck portion of the bottle 10. The typical squirt trigger bottle assembly includes a head 14 which has a squirt nozzle 16 at the forward end thereof, and has a reciprocating trigger 18 which extends downwardly from the head portion 14. As is also well-known in the art, extending downwardly from the head portion 14 into the bottle is usually a fluid tube, which is part of an overall pump assembly incorporated within the head portion. It is well-known that in order to operate the device, the reciprocating trigger is reciprocated by the user by simply pulling it in the direction illustrated by the arrow in FIG. 2, which creates a vacuum and pulls fluid up the fluid tube which is then ejected through the squirt nozzle 16. The construction, assembly and mode of operation of such squirt trigger type bottles is well known in the art.

The inventive subject matter of the present invention consists of creating a head which is adapted to seat onto the standard squirt trigger type bottle assembly as described above. As particularly shown in FIGS. 1 and 2 of the drawings, the novelty head of the present invention is generally a head which is formed in order to simulate a type of animal, or any figure for that matter.

The novelty head 20 is formed of a moldable material such as rubber, plastic, or other types of moldable materials. In the typical manufacturing process, it is intended that the head would be molded, and it has been found that rubber is an ideal material for use in connection with the present invention. However, the particular material utilized is not considered to be critical to the present invention since any type of moldable material that can be molded into a desired shape may be utilized.

Figure 2:
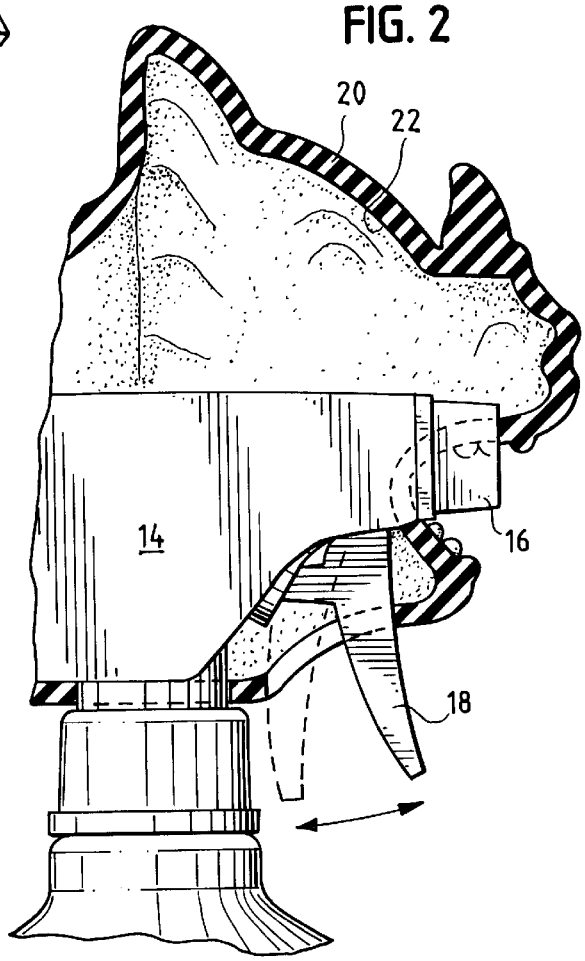
FIG. 2 is side elevational view, partly in cross-section, illustrating the manner in which the head mounts to the head of squirt trigger bottle.

The novelty head 20 is shown to have a hollow configuration and forms a chamber 22, and as shown in FIG. 2, accommodates the head 14 of the squire trigger assembly. As shown in FIG. 1, the lower portion 23 of the novelty head 20 is provided with a keyhole-shaped opening generally illustrated by the numeral 24. The keyhole-shaped opening may also be illustrated and exemplified in FIGS. 4, 5, and especially FIG. 8 of the drawings.

It will be observed that the keyhole-shaped opening 24 generally includes a circular opening 26, which is sized in a manner to accommodate and snugly fit onto the top portion of the cap 12. Extending laterally outwardly from the circular opening portion 26 is a substantially rectangular shaped opening 28. It will be observed that the substantially rectangularly shaped opening 28, accommodates the insertion of the trigger 18 therethrough, and further, by being rectangularly shaped, and as generally illustrated in FIG. 2 of the drawings, will accommodate the reciprocating motion of the reciprocating trigger 18 when the bottle is in use.

A second opening 32 is provided in the novelty head 20 and shown to be spaced above the keyhole-shaped opening 24. As shown in FIGS. 1, 2, and 3, the second opening 32 is intended to accommodate the insertion therethrough of the squirt nozzle 16.

As further illustrated in the drawings, if the novelty head is intended to be formed in the shape of an animal, such as a fish, dinosaur, or other such animal, it is contemplated that in the preferred embodiment, the keyhole-shaped opening 24 which includes the circular opening 26 and the substantially rectangular opening 28 will be formed as the lower portion of the animal head, that is, below the mouth, and the second opening 32 is formed in the mouth area of the animal head in order to accommodate the squirt nozzle 16 therethrough and to extend out through the mouth of the formed animal head. However, it is contemplated that whatever shape that the manufacturer desires to mold, it is contemplated that the second opening 32 which accommodates the squirt nozzle 16 therethrough would be worked into the overall design and shape of the formed novelty head in order maintain the shape of the head and incorporate both openings where needed in order to preserve the shape of the head and nevertheless provide the openings required in order to mount the same on the cap 12 of the bottle 10, and to accommodate the reciprocating trigger 18, and the squirt nozzle of the overall squirt trigger bottle assembly.

As illustrated in FIG. 4, 5 and 6 of the drawings, where the animal head 20 requires that the lower jaw of the animal be in an elevated position in order to simulate the realistic aesthetic effects of the animal head, the keyhole-shaped opening 24 may be modified by extending the rectangular opening portion 28 of the keyhole-shaped opening 24 in an arcuate or curved path upwardly and away from the circular opening 26. For example, FIG. 4 is intended to illustrate a dinosaur type head, which would have an elevated lower jaw, and hence requiring the rectangular opening to be arcuately extended upwardly and away from the circular opening 28. In this embodiment, the second opening 32 is clearly illustrated as being formed in the mouth area such that once the head 20 is mounted onto the squirt trigger bottle assembly, the device will have a novelty effect in that the reciprocating trigger is free to move, and the squirt of fluid emanating from the squirt nozzle 16 will emanate from the mouth of the animal.

FIGS. 3 and 6 of the drawings illustrate still a further embodiment of the invention. It will be observed in FIG. 3 that interposed between the circular opening 26 and the rectangular opening 28 are a pair of stabilizing tabs 35 which are created by not fully excising or cutting the rectangular opening 28 all the way to the circular opening 26. It has been found that in some instances in forming a molded head as a novelty for seatment for seatment on a squirt trigger bottle, if the head is found to have an elongate configuration, stabilizing tabs 35 have the ability to stabilize the head 20 when mounted onto the cap 12 of the bottle 10. However, the stabilizing tabs 35 would only be required if the particular shape of the head molded has instability due to its elongate configuration. For example, in FIG. 6 of the drawings, a head shaped as a baby seal is illustrated, with the stabilizing tabs identified by the numerals 38, formed in the nature of the arms of the animal. However, it has been found that the stabilizing tabs 35 (38) are not required or necessary in the typical molded formed head such as, for example, the type of head illustrated in FIG. 1. In this instance, the circular opening 26 forming a part of the keyhole-shaped opening 24 is sized to be approximately the size of the outside diameter of the cap 12 such that a snug fit is achieved in mounting the head onto the cap 12. Further, in most instances, it is found that the second opening 32 which accommodates the squirt nozzle 16 therethrough will function to stabilize the entire head 20 when mounted on the cap 12 and prevent the head 20 from falling off or being easily withdrawn from the device.

With specific reference to FIGS. 7 and 8 of the drawings, it will be observed that the novelty head 20 is provided with a keyhole shaped opening 24 which is basically in a planar configuration. That is, the circular opening 26 and a rectangular opening 28 are located in the same plane. This is caused by the configuration and shape of the head as required in order to exemplify the particular animal head as molded. This is distinguished from other novelty heads as depicted in FIGS. 3 through 6 of the drawings wherein the rectangular opening 28 is arcuately disposed relative to the circular opening 26.

Further, FIG. 7 illustrates still a further feature of the present invention. As illustrated, there is provided an aperture 40 which is formed in the top portion of the novelty head 20, and accommodates the insertion of a glow bar 42 therein. Glow bars 42 are commonly known, and are believed to contain chemical composition which when mixed, creates a light energy source and will glow in the dark. The novelty feature provided by the glow bar 42 is that when inserted into the aperture 40 of the head 20, and activated, light will be emitted from the glow bar, and will cause the novelty head to glow. It is assumed, of course, that the moldable material from which the novelty head 20 is formed is selected so that light is permitted to be transmitted through the material. It is contemplated that either rubber or plastic, such as polyvinyl chloride would accomplish this purpose.

Figure 9:
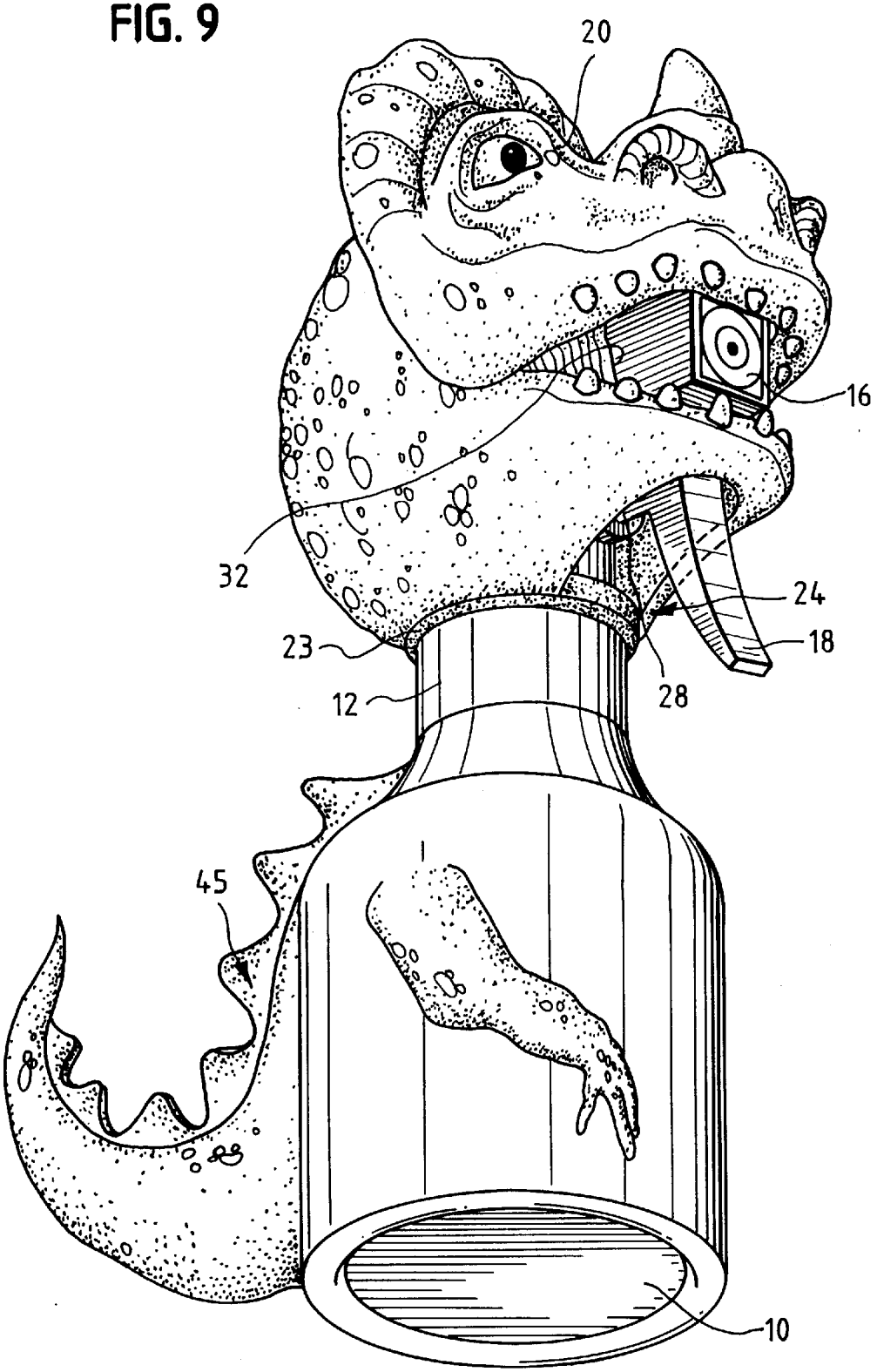
FIG. 9 is a elevational plan view showing an additional embodiment of the invention which provides an animal body portion fitted over the bottle to enhance the novelty aspect of the head portion forming the invention herein.

FIG. 9 illustrates still another further embodiment of the invention which is provided in order to enhance the novelty features of the invention. As illustrated therein, an animal body skin 45 is provided which is intended to simulate the body portion matching the novelty head 20 created for the top of the squirt bottle assembly. It is contemplated that the body skin 45 would be made out of a very pliable material such that it can envelop the bottle, and create the novelty affect of presenting an entire animal figure when inserted over the bottle 10. It is contemplated that body skins 45 may be formed for any particular head intended to be molded as exemplified for example in FIGS. 3 through 5 of the drawings.

Figure 10:
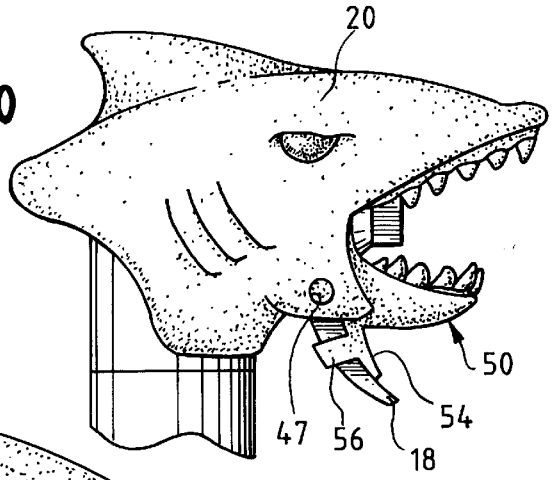
FIG. 10 is a side elevational view showing an embodiment of the invention which includes a moveable lower jaw portion which interconnects with the sprayer trigger of the spray bottle assembly such that upon movement of the trigger, the jaw moves upwardly and downwardly respectively.
Figure 11:
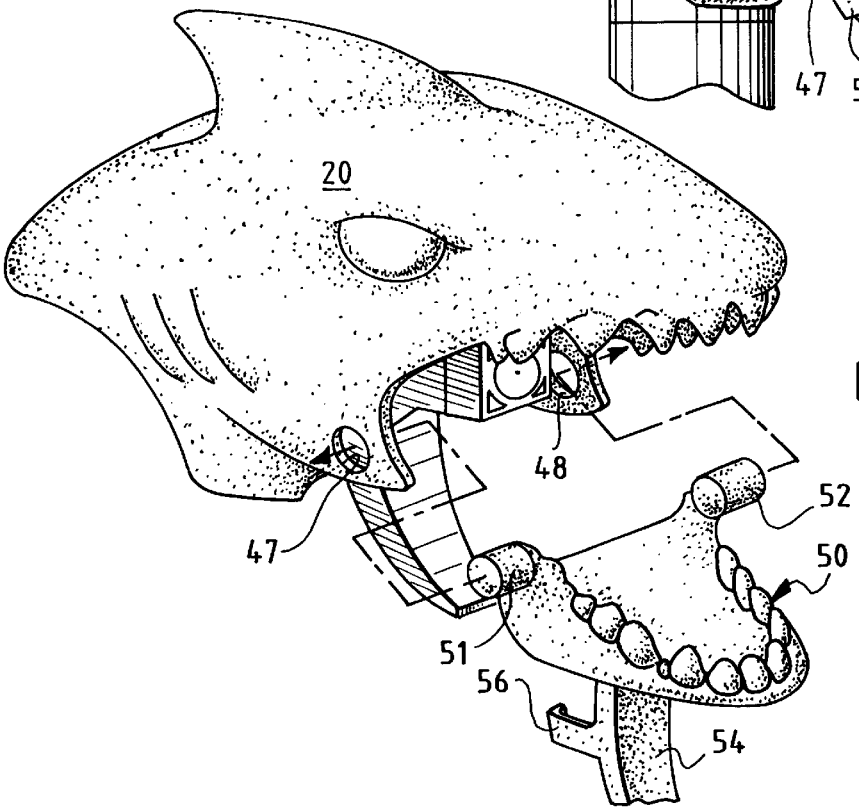
FIG. 11 is a front plan view showing the manner in which the moveable jaw interconnects with the head portion of the novelty head.

A further feature of the invention is illustrated in FIGS. 10 through 14 of the drawings. For ease of reference, like numerals are utilized to refer to like parts. As shown in FIGS. 10 and 11 of the drawings, the novelty head 20 may be formed to include the upper portion of the animal head as exemplified in FIG. 10 with the upper head portion provided with a pair of tab receiving openings 47 and 48 respectively. A separate lower jaw 50 is provided which is provided with opposed tabs 51 and 52 respectively adjacent the rear portion of the jaw 50. The jaw 50 may further be provided with a depending flange 54 which includes a pair of mounting hooks 56 formed thereon. It will be observed from a view of FIGS. 10 and 11 that the depending flange 54 including the mounting hooks 56 will lay onto the trigger 18 with mounting hooks 56 securing the depending flange 54 to the trigger 18. The lower jaw 50 is mounted by inserting the mounting tabs 51 and 52 into the tab receiving openings 47 and 48 respectively. The head 20 and lower jaw portion 50 are designed such that when the squirt trigger is in the rest position, the lower jaw 50 is closed as exemplified in FIG. 12. When the operator reciprocates the trigger 18 by pulling the same in order to activate the spray bottle, the pulling motion will cause the lower jaw to open and achieve the novelty affect of having the squirt nozzle 16 emit fluid from the open mouth of the animal head 20.

Figure 12:
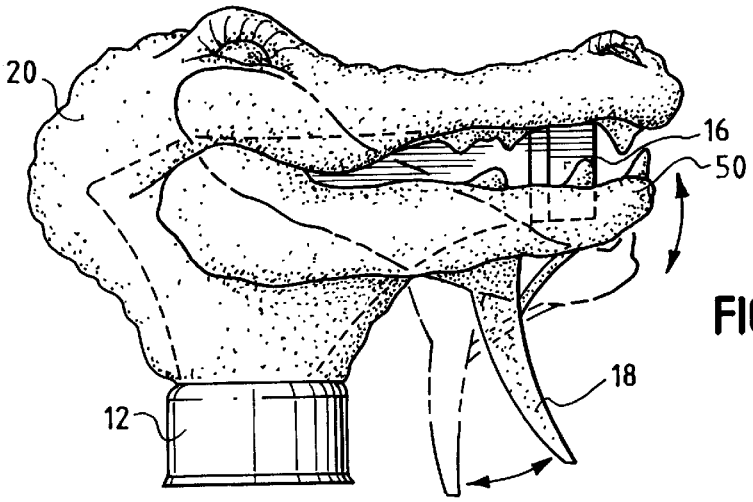
FIG. 12 is a side elevational view, partly in cross section, showing another version of a moveable lower jaw relative to the head portion and the manner of interconnection with the squirt trigger portion of the squirt bottle assembly.

As exemplified in FIG. 12, the depending flange emanating from the lower jaw 50 may take the form of a simple flange having an aperture therein which would permit the squirt trigger 18 to be inserted therethrough. This type of mounting arrangement is more adequately shown in FIGS. 13 and 14 of the drawings.

Figure 13:
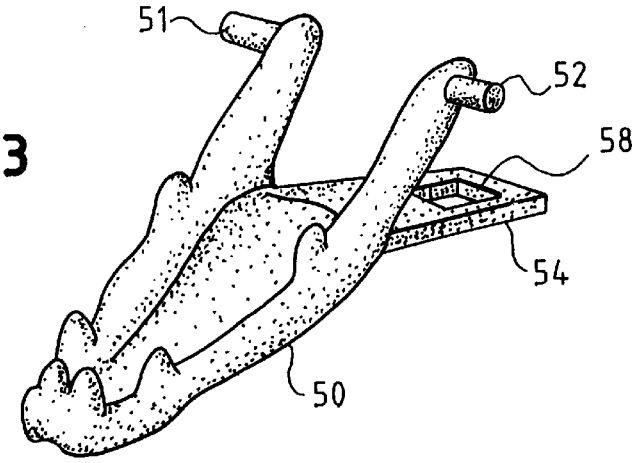
FIG. 13 is a plan view showing another version of a lower moveable jaw member which includes an alternate form of tab attachment for attaching to the squirt trigger assembly.
Figure 14:
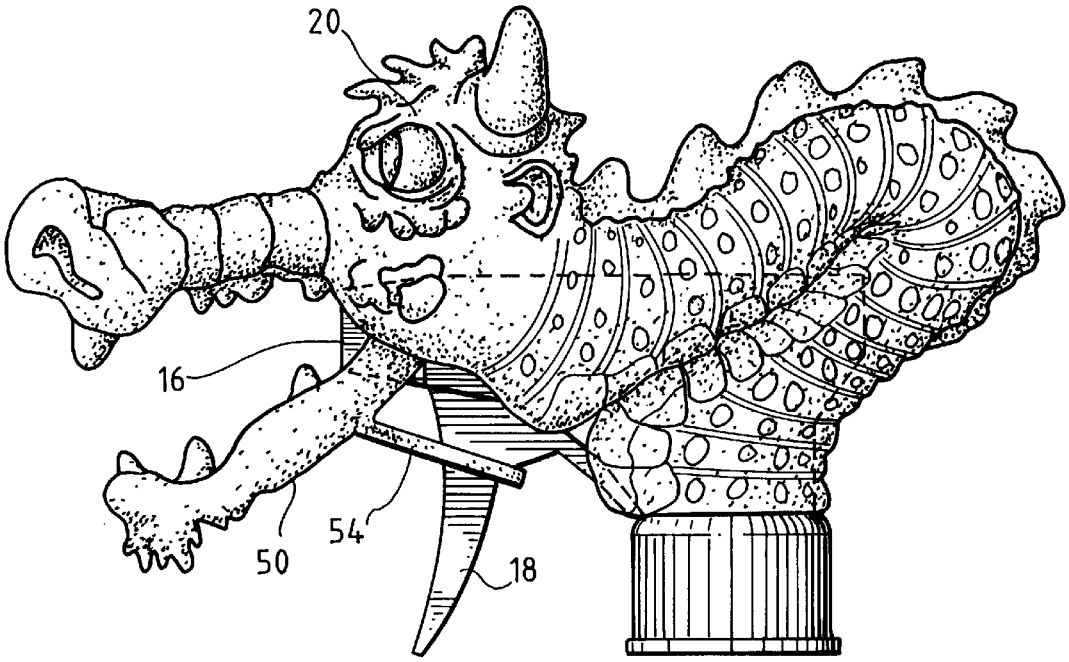
FIG. 14 is a side elevational plan view showing the lower jaw member of FIG. 13 mounted to a figure head, and interconnected with the squirt trigger of the squirt bottle assembly.

In FIG. 13, the lower jaw 50 is shown to include the mounting tabs 51 and 52 respectively. The depending flange 54 is provided with a trigger mounting aperture 58 which accommodates the insertion of the squirt trigger 18 therethrough (See FIG. 14). It will further be appreciated from a view of FIG. 14 that when the operator pulls on the squirt trigger 18 as shown in FIG. 14, the lower jaw is open relative to the head 20, and presents the squirt nozzle 16 from the mouth of the head 20 thereby to achieve the novelty affect as desired.

It will be appreciated from the above description that the present invention provides a novelty device particularly suited for children's use, whereby a novelty animal type head, or other format of head may be manufactured from a moldable material and includes appropriate openings for mounting the same to the neck of a squirt trigger type bottle. Further novelty features are obtained by providing the novelty head with a moveable lower jaw which interconnects with the spray trigger of a squirt trigger type bottle such that manipulation and reciprocation of the trigger will cause a concomitant movement of the lower jaw to open and close the same such that when emitting fluid from the squirt nozzle, the fluid is emitted when the jaw is in the open position. Further novelty features also provide a body skin portion which with the type of head utilized for the bottle such that an entire animal figure would be presented with the novelty head affixed to the top of the bottle, and the body skin fitted over the bottle portion of the device.

While there has been described what is at present considered to be the preferred embodiments of the invention, it will be understood that various modifications may be made therein, all of which such obvious modifications are intended to fall within the true scope and spirit of the present invention.

We claim:

1. A formed novelty head adapted for seatment upon a squirt trigger bottle of the type including a bottle having a neck and a cap fitted onto the neck, and a squirt trigger assembly mounted on the cap including a reciprocating trigger, and a squirt nozzle positioned above the reciprocating trigger adapted to eject the fluid through the squirt nozzle when the trigger is reciprocated, comprising, a three-dimensional novelty head formed from a moldable material, said head defining a hollow chamber for accommodating the squirt trigger assembly therein, and having a lower portion thereof, said lower portion including a first opening having a substantially keyhole shaped opening comprising a substantially circular opening and having a substantially rectangular opening extending laterally from said circular opening, a second opening spaced upwardly from said first opening, said first opening adapted to seat said head onto the cap of the bottle through said substantially circular opening which circumferentially seats about said cap, and having the reciprocating trigger positioned in the rectangular opening, and said second opening accommodating the insertion of the squirt nozzle therethrough, whereby said novelty head may be mounted onto the cap of a bottle with the cap positioned in the substantially circular opening, and accommodating the reciprocating trigger in the laterally extending rectangular opening, and the squirt nozzle extending through the second opening such that the squirt trigger bottle is operational to eject a fluid while the novelty head is seated onto the bottle.

2. The formed novelty head as set forth in claim 1 above, wherein said first opening consisting of the circular opening and the laterally extending rectangular opening extending laterally therefrom are substantially planar in orientation.

3. The formed novelty head as set forth in claim 1 above, wherein said first opening includes a substantially circular opening, and having a rectangular opening extending laterally therefrom, said rectangular being arcuately disposed relative to said circular opening and conforming to the shape of the formed novelty head thereby permitting a variety of shaped heads to be formed.

4. The formed novelty head as set forth in claim 1 above, wherein said keyhole shaped opening further includes at least one stabilizing tab associated therewith and adapted to engage a portion of the squirt trigger assembly mounted on the cap of the bottle thereby to stabilize the novelty head when inserted thereon.

5. The formed novelty head as set forth in claim 4 above, wherein said keyhole shaped opening includes a pair of stabilizing tabs carried on the rectangular opening thereof, and extending inwardly toward one another, thereby to grip a portion of the squirt trigger assembly when mounted on the cap and stabilize the novelty head when carried thereon.

6. The formed novelty head as set forth in claim 1 above, which further includes a animal body portion formed of a moldable material, and being sufficiently pliable in order to envelop the bottle portion of the device, said body portion being coordinated with the novelty head in order to provide a novelty device wherein the head and body portion of the animal is presented when inserted onto the squirt trigger bottle assembly.

7. The formed novelty head as set forth in claim 1 above, wherein the novelty head further includes an aperture provided on the top portion of the head, and accommodating a glow bar for insertion into said aperture, whereby upon insertion of the glow bar in the aperture, and activated, light is emitted through the head in order to present a head which glows light.

8. The formed novelty head as set forth in claim 1 above, wherein said novelty head is further provided with a jaw movably connected to said head portion, said jaw including a depending flange extending downwardly therefrom, said depending flange including connection means for interconnecting said depending flange to the squirt trigger portion of the squirt trigger bottle assembly, whereby upon manipulation of the squirt trigger, the lower jaw moves relative to the head portion and provides a novelty feature with a head having a moveable jaw portion such that said jaw is in the open position when fluid emits from the squirt nozzle, and is in the closed position when the device is at rest.

9. The formed novelty head as set forth in claim 8 above, wherein the head portion is provided with a pair of opposed tab receiving openings formed adjacent the side portion of the head, and the lower jaw is provided with a pair of opposed laterally extending tabs, whereby said lower jaw is mounted to said head by inserting said tabs into said tab receiving apertures in said head.

10. The formed novelty head as set forth in claim 9 above, wherein said lower jaw further includes a depending flange having connection means for interconnecting said jaw to said squirt trigger such that reciprocation of the squirt trigger will cause a concomitant reciprocation and movement of the jaw from an open to a closed position.

11. The formed novelty head as set forth in claim 10 above, wherein said depending flange includes a trigger receiving opening formed therein, such that said depending flange is mounted to said squirt trigger by inserting the squirt trigger into said trigger receiving aperture, whereby reciprocation of the trigger causes a concomitant movement of the jaw in an arcuately downward path thereby to simulate the opening and closing of the jaw relative to the head when the device is operated.

* * * * *